US005975521A

United States Patent [19]

Ono et al.

[11] Patent Number: 5,975,521

[45] Date of Patent: Nov. 2, 1999

[54] SHEET DISCHARGING APPARATUS HAVING MECHANICALLY DRIVEN WINGS

[75] Inventors: Takahiro Ono; Takeshi Kakinuma, both of Kyoto; Nobuyoshi Suzuki, Aichi; Yasuhiro Fujimoto; Masahiro Ueda, both of Ibaraki, all of Japan

[73] Assignees: Omron Corporation, Kyoto; Riso Kagaku Corp., Tokyo, both of Japan

[21] Appl. No.: 09/062,536

[22] Filed: Apr. 17, 1998

[30] Foreign Application Priority Data

Apr. 18, 1997 [JP] Japan ..... 9-115018

[51] Int. Cl.[6] ..... B65H 29/70

[52] U.S. Cl. ..... 271/188; 271/209

[58] Field of Search ..... 271/188, 209

[56] References Cited

U.S. PATENT DOCUMENTS 2,381,430 8/1945 Belluche ..... 271/188 X
4,354,408 10/1982 Carte ..... 271/188 X

FOREIGN PATENT DOCUMENTS 09067069 3/1997 Japan .
2563701 11/1997 Japan .

*Primary Examiner*—David H. Bollinger
*Attorney, Agent, or Firm*—Dickstein Shapiro Morin & Oshinsky LLP

[57] ABSTRACT

A sheet discharging apparatus includes a conveyor provided at one side of the body of the apparatus, and sorter trays and a large capacity tray provided on the opposing side. Wings are provided each rotatable about a rotation axis, on a discharging side of the conveyor, and a projection is formed in the front side in the sheet conveying direction of each wing. The projection is brought into contact with an urging member provided at a frame of the container which is movable in upward/downward directions. When sorter trays are used, the urging member is separate from the projection, so that upper surface of the wing is below a conveying surface. When the frame and urging member are elevated to use the large capacity tray, the urging member presses the projection upward, and hence wings are elevated to be positioned upper than the conveying surface. When a thick sheet is to be discharged, an operation lever is operated so as to retract the projection, preventing contact between the urging member and a projection. Therefore, the wings are not elevated. Accordingly, the wings can be raised/lowered without any electric mechanism, and a sheet discharging apparatus is provided which enables sure discharge and stacking of sheets on the large capacity tray, regardless of the thickness of the sheets.

6 Claims, 10 Drawing Sheets

SHEET DISCHARGING APPARATUS HAVING MECHANICALLY DRIVEN WINGS

BACKGROUND OF THE INVENTION

1. Field of the Invention

The present invention relates to a sheet discharging apparatus. More specifically, the present invention relates to a sheet discharging apparatus mounted on a discharging side of an image forming apparatus such as a printer or a copying machine, which apparatus including wings for curving opposing sides of a sheet upward to increase stiffness, when a sheet discharged from the image forming apparatus is discharged to a large capacity tray. This operation of curving opposing sides of the sheet to increase stiffness will be hereinafter referred to as upward curving.

2. Description of the Background Art

On a sheet discharging side of an image forming apparatus such as a printer or a copying machine, a tray (also referred to as a "bin") for receiving the discharged sheet is mounted. Besides an ordinary tray on which several to several tens of sheets (relatively small number of sheets) are stacked, there is a large capacity tray which is capable of stacking and containing a large number of sheets of more than one hundred at one time. Some image forming apparatuses are provided with sorting function, by preparing a plurality of ordinary trays mentioned above on which a small number of sheets can be stacked at one time, moving upward/downward the trays in accordance with the timing of discharge of the sheets, and sorting the discharged sheets to prescribed trays. The sheet discharging apparatus includes one type or a plurality of types of such trays.

FIG. 9A shows an example of a conventional sheet discharging apparatus. The conventional sheet discharging apparatus includes a large capacity tray, and a tray group including a number of stages of trays for sorting. As shown in the figure, a conveyor 2 is provided at a central portion in height direction on one side of an approximately rectangular body 1 of the apparatus. On a side of body 1 opposing to conveyor 2, a container 3 for receiving the discharged sheet is provided. The image forming apparatus (not shown) is arranged on the side of conveyor 2.

Conveyor 2 receives a sheet on which an image is formed by the image forming apparatus, conveys the sheet over a conveying surface 4 and discharges the sheet to container 3. The sheet conveying force is applied, in a copying machine, for example, by pinching the sheet from above and below by a pair of upper and lower discharge rollers provided near a discharge outlet and by rotating the rollers, so that the sheet is conveyed forward in the conveying direction. In a printer, it is possible that printing ink on the sheet is not yet dried. Therefore, a vacuum conveyor (suction belt) is used, whereby the sheet is conveyed with the conveyor touching only the non-printed surface of the sheet.

FIG. 9B is a front view of conveyor 2 viewed from the direction of the arrow IXB in FIG. 9A. Referring to FIG. 9B, a pair of wings 5 are provided at opposing edges near a discharging outlet of conveyor 2. Wings 5 are reciprocal between a first position where each wing protrudes upward from conveying surface 4 as represented by the solid line in FIG. 9B, and a second position where each wing is positioned below conveying surface 4 as represented by two-dotted chain in FIG. 9B. Specifically, wings 5 are arranged parallel to each other along the conveying direction, and adapted to be movable between the two positions mentioned above with opposing edges of the wings serving as rotation axes 5*a* for forward/rearward rotation. A solenoid 6 is provided as a driving source for the movement.

Solenoid 6 is coupled near an outer side at a bottom surface of wing 5 (an edge opposing to the center of rotation), and solenoid 6 is conducted, so that the outer side of wing 5 is urged upward and rotated about rotation axis 5*a* to be placed at the first position. By stopping conduction to solenoid 6, wing 5 is rotated in the opposite direction and placed at the second position.

When wing 5 is at the first position, an upper surface 5*b* of wing 5 provides an inclined surface which gradually rises in the outer and forward direction of conveying. When it is at the second position, the upper surface is horizontal and approximately flush with conveying surface 4. Upper surface 5*b* of wing 5 is adapted to be in contact with lower side surface of the sheet moving on conveying surface 4.

Accordingly, when wings 5 are at the first position, opposing edges of the sheet in the proceeding direction are lifted along the upper surfaces 5*b* of wings 5, that is, subjected to the upward curving, and the sheet is maintained in a state extending straight along the proceeding direction. In other words, the discharged sheet would never be bent at an intermediate portion in the proceeding direction with the front portion hanging loose downward. Further, since the sheet is discharged diagonally upward, the sheet can fly over a relatively long distance. When wings 5 are at the second position, the sheet is kept flat and not subjected to upward curving, and is discharged in horizontal direction.

Container 3 includes trays (bins) 7 allowing stacking of a small number of sheets arranged in multiple stages, and a large capacity tray 8 containing a large number of sheets. Trays 7 are provided inclined with the front side in sheet conveying direction raised upward, and the trays 7 are arranged aligned in vertical direction spaced by a prescribed distance from each other. Trays 7 can be elevated/lowered collectively by an elevating apparatus in body 1.

Large capacity tray 8 is made relatively deep so as to increase capacity, and has sidewalls 8*a* on opposing edges and a stop wall 8*b* erected in front. When large capacity tray 8 is used, the actual position of receiving the sheet is lower by a prescribed distance from the sheet discharging position. Therefore, the discharged sheet drops by this distance and stacked. Therefore, wings 5 are set at the first position so that the sheet is curved upward and discharged diagonally upward. Thus the discharged sheet never has its forward portion bent and discharged downward, but the sheet flies over a relatively long distance in a straight extended state. The sheet abuts stop wall 8*b* and guided by sidewalls 8*a,* so that the number of sheets are successively stack in large capacity tray 8.

When sheets are to be stacked on tray 7 of small capacity and wings 5 are kept at the first position, it becomes necessary to ensure large space between upper and lower trays 7, as the sheet is discharged with opposing edges raised, which results in the apparatus of larger size, or smaller number of mountable trays. Further, the sheet tends to fly relatively farther, and hence it is possible that the sheet goes out from the front side of tray 7. Therefore, wings 5 are set to the second position so that the sheet is discharged flat. This enables reduction in space between the trays. Since only a small number of sheets are stacked in tray 7, the distance from the sheet discharging outlet to the receiving surface of tray 7 is short. Therefore, even when the sheet is discharged in the horizontal direction without upward curving, sheets can be stacked neatly on tray 7. In this manner, conduction to solenoid 6 is controlled in accordance with the tray used, and wings 5 are set to the desired state.

FIGS. 10A and 10B show another example of the conventional sheet discharging apparatus in which a large capacity tray 8' has a function of wings. More specifically, large capacity tray 8' has wings 5' attached integrally on the side of sheet discharging outlet. Similar to wings 5 set at the first position shown in FIGS. 9A and 9B, each of the wings 5' provides an inclined surface gradually rising forward and outward along the conveying direction. When a sheet is conveyed, it is subjected to upward curving by upper ends of wings 5', and is contained in large capacity tray 8'. In such a structure, it is not necessary to elevate/lower wings 5' dependent on the tray used, so that the apparatus can be simplified and control is facilitated.

However, the conventional sheet discharging apparatus described above suffers from the following problem. When large capacity tray 8' is used, wings 5' are always used raised at the first position. As a result, if a sheet itself is sturdy as in the case of a thick sheet and opposing edges are raised, the central portion of the sheet tends to rise. When a vacuum conveyor is used as conveyor 2 and the rising force of the central portion of the sheet exceeds the vacuum attraction, the sheet would be away from the surface of the conveyor belt, and thus conveying force cannot be applied. When the sheet is pinched by a pair of upper and lower rolls, unnatural force may be applied to the sheet, resulting in undesirable bending.

In the structure shown in FIGS. 9A and 9B, control for conducting/shutting power to solenoid 6 dependent on the state of use is necessary, which control is complicated. Further, upward/downward movement of wings 5 is realized by an electric mechanism including solenoid 6 and conducting apparatus therefor. Accordingly, a space for the electric mechanism is necessary and cost increases. Further, there is a possibility of malfunction in the control system, which may lead to a failure.

In the structure shown in FIGS. 10A and 10B, large capacity tray 8' must be mounted protruding in the direction of sheet discharge by the thickness of wings 5' (thickness of the wings in the discharging direction), which results in increased size of the whole apparatus.

SUMMARY OF THE INVENTION

Therefore, an object of the present invention is to provide a sheet discharging apparatus at a low cost.

Another object of the present invention is to provide a sheet discharging apparatus which can be reduced in size.

Another object of the present invention is to provide a sheet discharging apparatus allowing stacking and storage of sheets in accordance with quality of the sheets to be stored.

A still further object of the present invention is to provide a sheet discharging apparatus in which wings can be moved upward/downward dependent on a tray to be used, by a simple mechanism and control.

The above described objects of the present invention can be attained by the sheet discharging apparatus having a sheet discharging unit, including a container tray movable upward/downward for receiving and stacking discharged sheets when positioned near the discharging unit, wings provided at the discharging unit for raising upward opposing edges of a discharged sheet when urged, and an urging member moving upward/downward relative to the upward/downward movement of the container tray, the wings being urged by the urging member.

According to another aspect, the present invention provides a sheet discharging apparatus having a sheet discharging unit, including a container tray movable upward/downward for receiving and stacking discharged sheets when positioned near the discharging unit, wings provided at the discharging unit for raising upward opposing edges of a discharged sheet when urged, an urging member moving upward/downward in relation to the upward/downward movement of the container tray, and switch means for not transmitting urging force by the urging member to said wings when the sheet is thick, and for transmitting the urging force by the urging member to the wings when the sheet is thin.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIGS. 2A, 2B to 4A, 4B show details of edge portions of the wing in the conveying direction, illustrating function of the first embodiment.

DESCRIPTION OF THE PREFERRED EMBODIMENTS

Figure 1A:
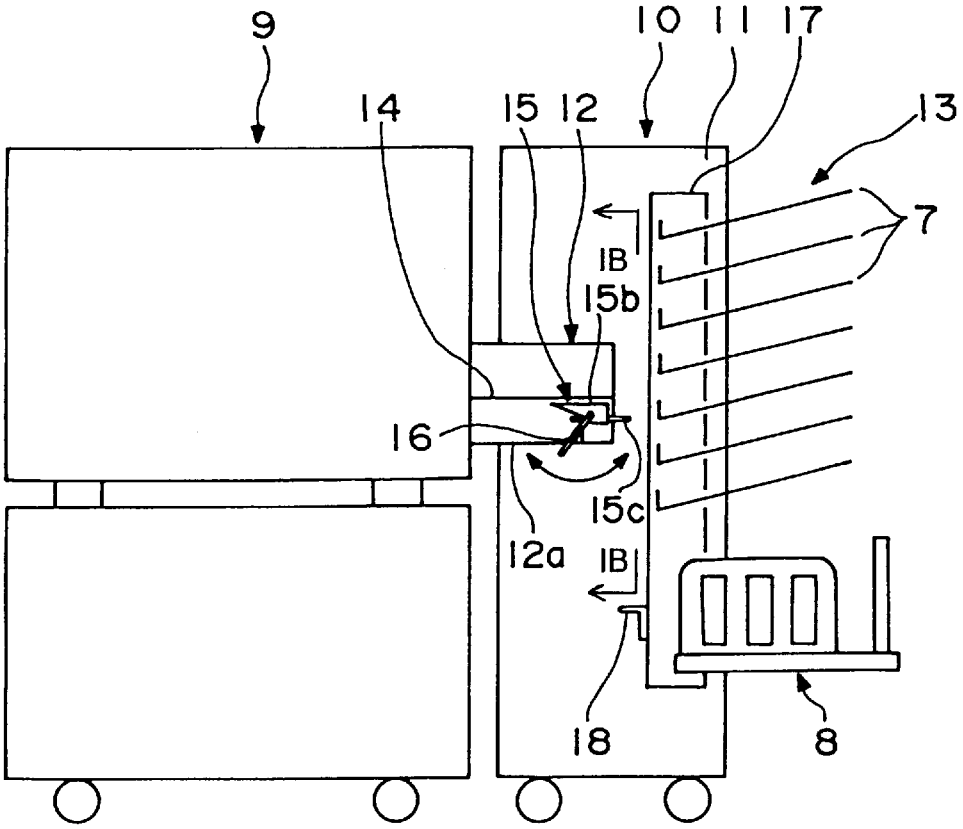
FIG. 1A is a cross sectional side view showing a structure of the sheet discharging apparatus in accordance with a first embodiment of the present invention.

Referring to FIG. 1, a sheet discharging apparatus 10 in accordance with the first embodiment of the present invention has a sheet sorter having a sorting function, provided integrally with an image forming apparatus 9, on the side of a sheet discharging outlet of image forming apparatus 9 such as a printer or a copying machine.

Sheet discharging apparatus 10 includes an approximately rectangular body 11, a conveyor 12 provided at a central portion in height direction of body 11 on the side of image forming apparatus 9, and a container 13 provided at a side of body 11 opposing to conveyor 12. Conveyor 12 is not necessarily attached physically on body 11. For example, it may be attached to the side of image forming apparatus 9 with its tip end arranged to be inserted to the body 11.

Conveyor 12 has a vacuum conveyor 14 at the central position in the height direction. Wings 15 which are movable upward/downward are provided in front of vacuum conveyor 14 in the conveying direction (at an end portion on the side of the container). Vacuum conveyor 14 includes a pair of conveyor belts 14*a* arranged on opposing sides of a conveying surface, and a fan 14*b* placed below and between the pair of conveyor belts 14*a*. By the operation of fan 14*b*, suction force is generated so that a sheet 20 to be discharged is sucked and attracted to be held on conveyor belts 14*a*. When conveyor belts 14*a* are driven and rotated, the attracted sheet 20 is conveyed and discharged to container 13. A number of through holes are formed in the belt surfaces of conveyor belts 14*a*, so that air sucked by fan 14*b* is drawn inside through the through holes of conveyor belt 14*a*. This ensures attraction of sheet 20 onto conveyor belt 14*a*.

Figure 1B:
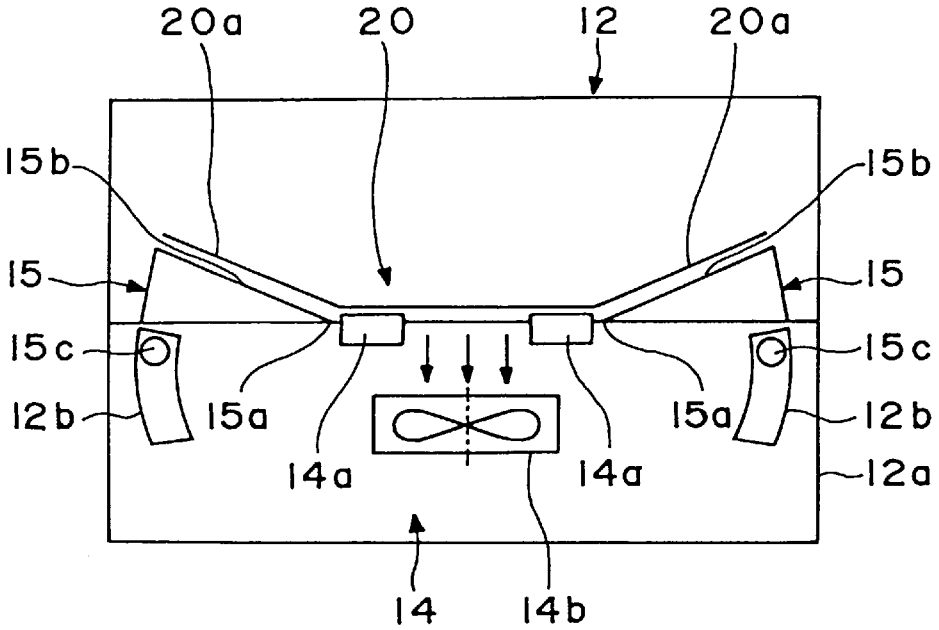
FIG. 1B is a front view taken from the direction of the arrow 1B in FIG. 1A.

Wings 15 are provided movable upward/downward along opposing edges of conveyor belts 14*a* as in the prior art (see FIG. 1B). Each wing 15 has an approximately triangular vertical cross section orthogonal to the sheet conveying direction. Vertexes of the triangles are positioned on opposing sides of wings 15. The wing also has an approximately triangular vertical cross section parallel to the sheet conveying direction, with the vertexes of the triangles positioned behind the feeding direction (see FIG. 1A). In other words, wing 15 has such a shape that is thicker outward and forward along the feeding direction.

Edge portions of opposing sides of wings 15 serve as rotation axes 15*a*, and each wing rotates forward/rearward in a prescribed angular range. By such rotation, wing is reciprocal between a first position where an upper surface 15*b* of the wing protrudes upward from conveyor belt 14*a* and a second position where upper surface 15*b* of wing 15 is positioned lower than conveyor belt 14*a*. FIG. 1A shows the second position while FIG. 1B shows the first position. Because of gravity and balance of wings 15, each wing is set such that it rotates with the outer side moving downward to be at the second position by the weight of itself, unless an external force is applied.

Here, in the sheet discharging apparatus in accordance with the present invention, a projection 15*c* having a thin bar-like shape is provided to protrude at a lower portion in front of wing 15 in the sheet conveying direction. The projection 15*c* has a tip end formed to be protruded outward than the front surface of a box body 12*a* of conveyor 12 in the conveying direction. In other words, wing 15 is mostly contained in box 12*a*.

Referring to FIG. 1B, box 12*a* is open up from the conveying surface 14*a* of conveyor belt in front of the sheet conveying direction, allowing discharge of the sheet. At a prescribed position of a front surface lower than the conveying surface, two guide holes 12*b*, 12*b* curved arcuate are provided. Tip ends of projections 15*c* attached to wings 15, 15 are protruded outward through guide holes 12*b* and 12*b*. Further, radius of curvature of guide hole 12*b* is made approximately conforming to moving track of projection 15*c* accompanying forward/rearward rotation of wing 15. Accordingly, projection 15*c* moves guided by guide hole 12*b*. In other words, movable range of projection 15*c* and hence of wing 15 is regulated by guide hole 12*b*. More specifically, when projection 15*c* is positioned at an upper edge of guide hole 12*b* as shown in FIG. 1B, wing 15 is at the highest first position, and when projection 15*c* is positioned at a lower edge of guide hole 12*b*, wing 15 is at the lowest second position.

Figure 2A:
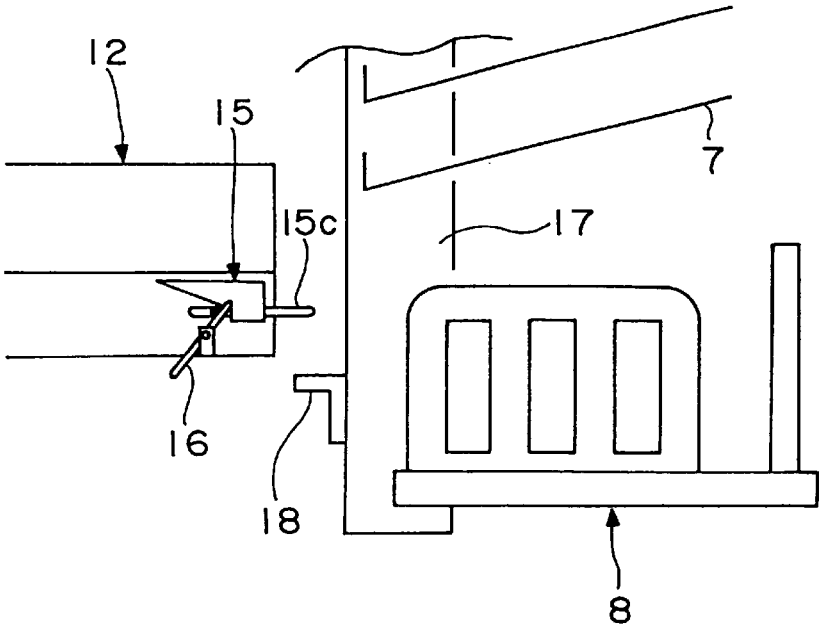
Figure 2B:
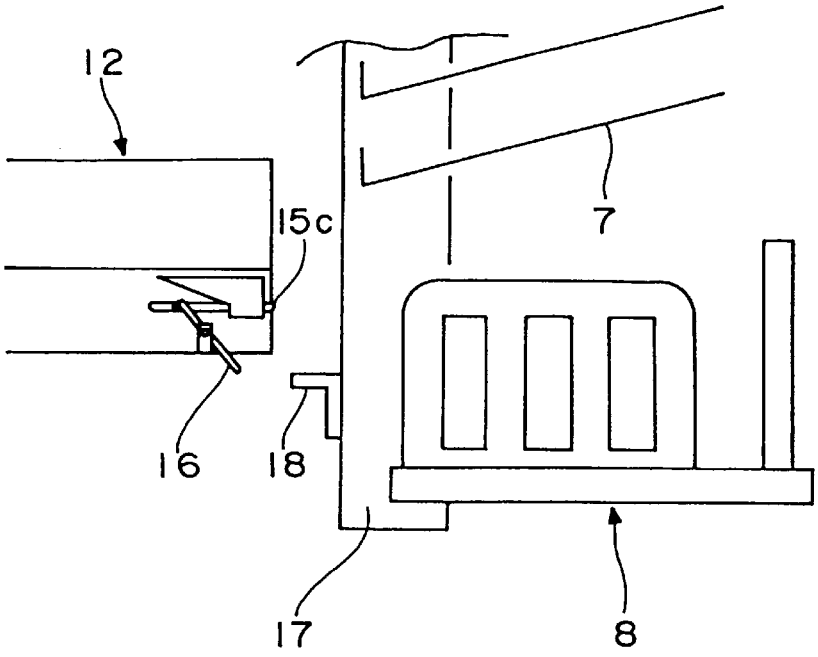

Further, in the present embodiment, projection 15*c* is attached movable in a thrust direction at a lower end of wing 15. An operation lever 16 is connected to a proximal end (rearward in the conveying direction) of projection 15*c*, and by rotating operation lever 16 forward/rearward, the projection moves forward to assume a state protruding considerably from the front surface of box 12*a*, as shown in FIG. 2A, and moves backward to assume a state protruding only slightly from the front surface of box 12*a*, as shown in FIG. 2B. Operation lever 16 and projection 15*c* are in contact with each other and separable. More specifically, a convex portion is provided at a side surface of projection 15*c*, and operation lever 16 is brought into contact with the convex portion. Therefore, when projection 15*c* is urged upward by urging member 18 as will be described later, it is separated smooth from operation lever 16, allowing elevation of projection 15*c*.

Container 13 includes, in this example, trays each for containing a small number of discharged sheets, and a large capacity tray 8 capable of containing a large number of sheets. A plurality of trays 7 are prepared arranged in multiple stages in vertical direction, so as to enable use as a sorter. It goes without saying that the trays may not be used as a sorter, and sheets may be discharged to a prescribed one of the trays 7. Trays 7 and large capacity tray 8 are mounted on a frame 17, and movable upward/downward collectively. Specific structures of trays 7 and large capacity tray 8 are the same as those of the prior art. Therefore, detailed description thereof is not repeated.

By an elevating apparatus contained in body 11, the plurality of trays 7 and large capacity tray 8 are moved upward/downward collectively on frame 17. By moving upward/downward the trays 7 and large capacity tray 8 to position a prescribed tray 7 or the large capacity tray 8 aligned with the sheet discharging surface of conveyor 12, the discharged sheet is received and stacked.

In the present embodiment, urging member 18 is mounted at a prescribed position on a side surface of frame 17 on the side of conveyor 12. Urging member 18 has an approximately L shape, with one side approximately orthogonal to the direction of movement of container 13 and protruding to the side of conveyor 12. This one side is longer than the distance between the tip end of projection 15*c* largely protruding forward and frame 17, and shorter than the distance between the tip end of projection 15*c* moved rearward and the frame 17. More specifically, when projection 15*c* moves forward, urging member 18 is brought into contact with projection 15*c*, and when projection 15*c* moves rearward, urging member 18 goes out of contact with projection 15*c*.

The other side of urging member 18 is fixed on frame 17 with its tip end facing downward. Accordingly, urging member 18 is in contact with projection 15*c* and reaction force generated when pressing down acts in the direction of pressing urging member 18 toward frame 17. Accordingly, frame 17 and urging member 18 can be firmly joined.

Position of attaching urging member 18 is approximately the same as the height position of large capacity tray 8, so that the tray and urging member satisfy relative positional relation such that when large capacity tray 8 is placed at the sheet discharging position, urging member 18 is brought into contact with and presses projection 15*c* upward. In the present embodiment, urging member 18 is formed by a plate spring.

Operation of the sheet discharging apparatus in accordance with the present embodiment will be described. First, operation from a state when discharging and stacking of sheet is switched from tray 7 to large capacity tray 8 will be described. Referring to FIG. 1A, when one of or some of trays 7 are used as a sorter or for discharging and stacking a small number of sheets in the ordinary operation, urging member 18 is separate from projection 15*c*. Since there is not an upward force acting on projection 15*c* formed integrally with wing 15, wing 15 lowers by the weight of itself, projection 15*c* is supported by the lower edge of guide hole 12*b*, preventing further lowering, and hence wing 15 is stationary and rest on the second position shown in the figure. Accordingly, upper surface 15*b* of wing 15 is positioned flush with or lower than conveyor belt 14*a*. Accordingly, the sheet conveyed over conveyor belt 14*a* is discharged extending straight and flat, and stacked on a prescribed tray 7.

For switching to large capacity tray 8, frame 17 is elevated. Accordingly, large capacity tray 8 is elevated, together with urging member 18. An upper surface of one side of urging member 18 protruding in the direction of conveyor 12 abuts the lower surface of projection 15*c*. When frame 17 and urging member 18 are elevated further, upward urging force (pressing force) is applied from urging member 18 to projection 15*c*. By the urging force, projection 15*c* moves to go upward. More specifically, upward force is applied through projection 15*c* to the tip end in the sheet conveying direction of wing 15 which is formed integrally with projection 15*c*. Since wing 15 is maintained at the second position simply by the weight of itself, wing 15 is rotated about rotation axis 15*a* by the urging force, so that outer side is elevated.

When projection 15*c* reaches uppermost portion of hole 12*b*, projection 15*c* abuts the upper edge of hole 12*b*, and hence further movement upward is prevented. Lowering of projection 15*c* is prevented by urging member 18. Therefore, wing 15 is placed at the first position, with upper surface 15*b* of wing 15 protruding upward from conveyor belt 14*a* and providing an inclined surface crossing at a prescribed angle with conveyor belt 14*a* (see FIGS. 1B and 3A).

Accordingly, sheet 20 conveyed over conveyor belts 14*a* have opposing edges 20*a* in contact with upper surfaces 15*b* of wings 15 and curved upward, whereby stiffness is increased (see FIG. 1B). In other words, the angle formed by upper surfaces 15*b* of wings 15 at the first position and conveyor belts 14*a* is selected to be appropriate for the upward curving of sheet 20. Therefore, discharged sheet 20 does not immediately fall but stacked in large capacity tray 8 in a stable manner.

Accordingly, the sheet after discharge does not have the front portion hanging downward, and the sheet flies relatively far in a straight extended state. Therefore, when the large capacity tray is to be used, wings are protruded so that sheets are discharged relatively far in a straight extended state, so that sheets can be stacked on the large capacity tray positioned lower by a prescribed distance from the discharging portion, not bent while the sheets drop.

Figure 3A:
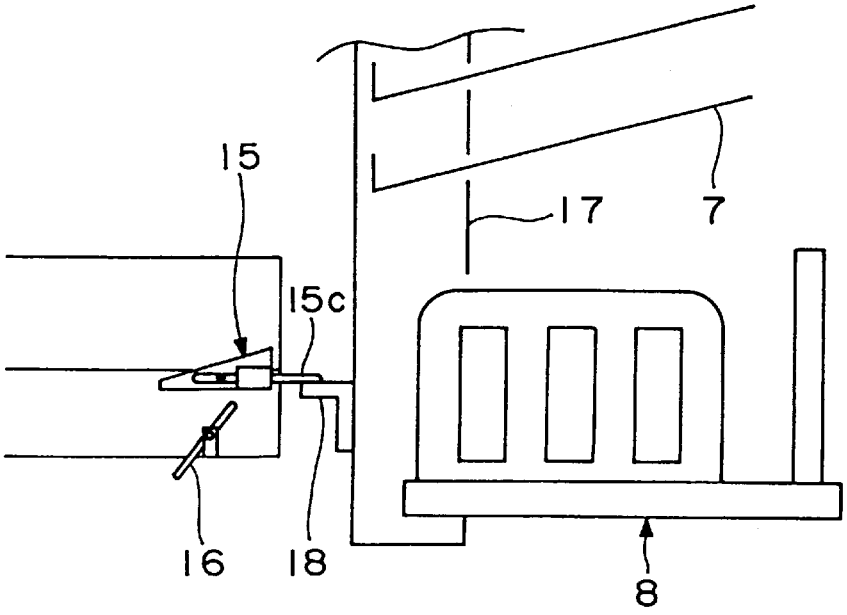

Switching from the large capacity tray 8 shown in FIG. 3A to trays 7 is performed in the following manner. When frame 17 is moved downward from the state of FIG. 3A, urging member 18 formed integrally with the frame 17 also lowers. Accordingly, projection 15*c* which has been supported by urging member 18 lowers, and wing 15 formed integrally with projection 15*c* rotates rearward, with the outer side lowered.

Frame 17 (urging member 18) further lowers, and projection 15*c* also lowers further. When projection 15*c* abuts the lower edge of guide hole 12*b*, further lowering is prevented. Thus, wing 15 is returned to the second position where the upper surface 15*b* is flush with or lower than conveyor belt 14*a*. When frame 17 further lowers from this state, urging member 18 is separated from projection 15*c*. Thus the original state shown in FIG. 1B is recovered. Prescribed one of the trays 7 is aligned at the height position of conveyor belt 14*a*, and switching operation is completed.

Accordingly, the sheet is discharged to the tray positioned near the discharging portion without upward curving.

As described above, by moving the urging member upward/downward in relation to the upward/downward movement of frame 17 or large capacity tray 8, it is possible to elevate/lower wings 15 by mechanical linkage, as described above. Accordingly, it becomes unnecessary to provide means for driving the wings such as the solenoid, which was indispensable in the prior art. Further, special sensing and control for moving upward/downward the wings are unnecessary.

Further, in the present invention, urging member 18 is formed of a plate spring. Therefore, even when urging member 18 rises slightly upper than the first position, the plate spring elastically deforms, so that excessive force is not applied to projection 15*c* (wing 15) while elevation of frame 17 (large capacity tray 8) is allowed.

Figure 4A:
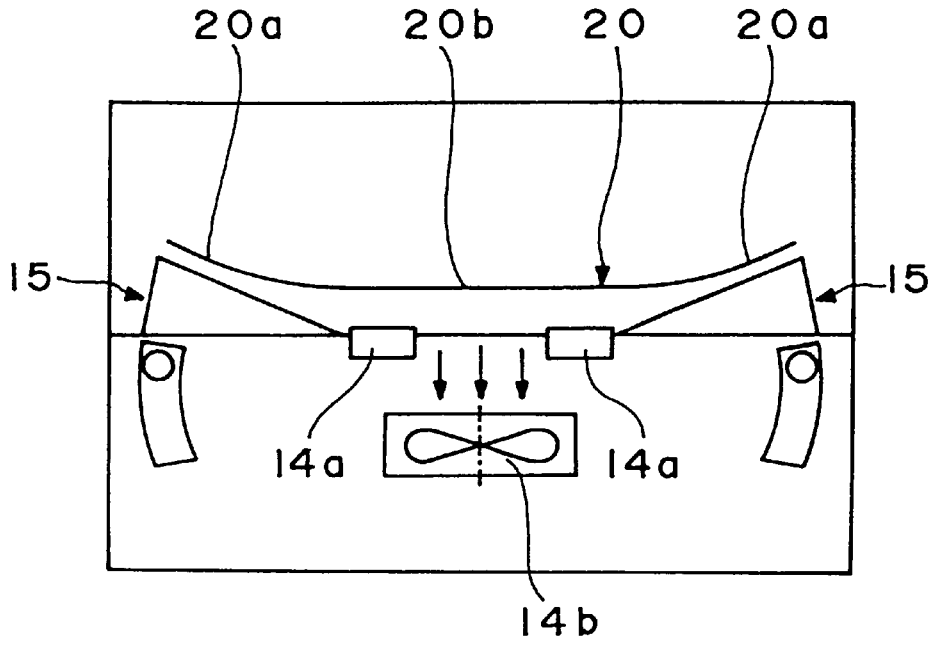

When the large capacity tray is used for thick and sturdy sheet 20 and opposing edges 20*a* of sheet 20 are raised by wing 15 as shown in FIG. 4A, the strongness of sheet 20 exceeds suction force by fan 14*b*, so that central portion 20*b* of sheet 20 is raised and separated from the belt surface (conveyor surface) of conveyor belt 14*a*. Accordingly, holding by suction fails, and prescribed conveying force cannot be applied to sheet 20.

Figure 3B:
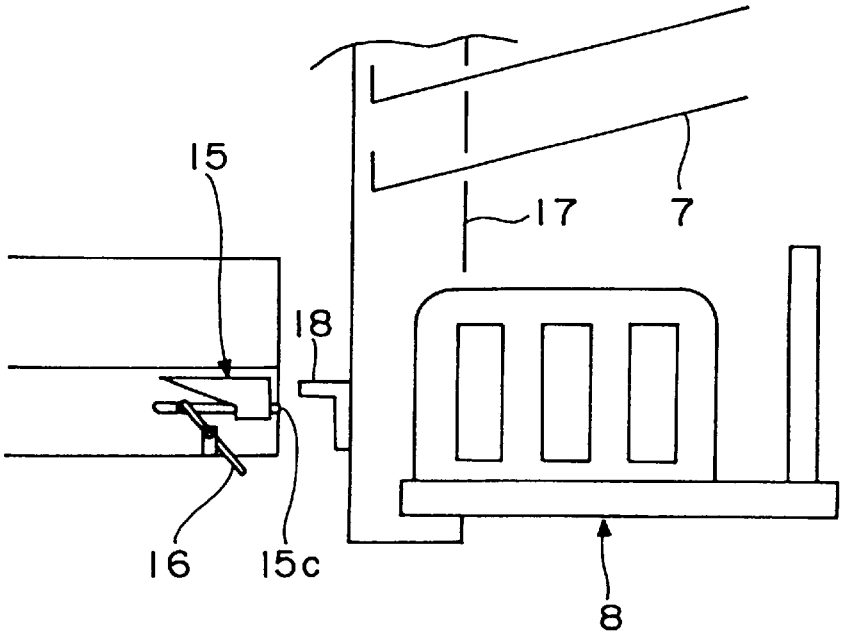
Figure 4B:
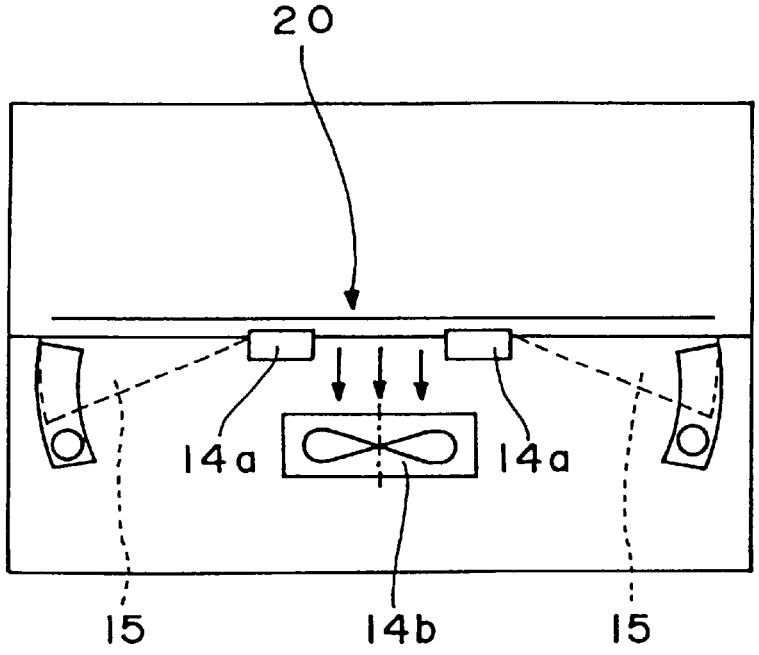

Therefore, in this case, first, operation lever 16 is rotated to move projection 15*c* rearward. Thereafter, large capacity tray 8 is elevated in the similar manner as described above, so that urging member 18 is elevated. Even when the upper surface of one side of urging member 18 projecting in the direction of conveyor 12 is placed at the position of projection 15*c*, urging member 18 is not in contact with projection 15*c*, and therefore upward urging force does not act on projection 15*c*. Even when urging member is further elevated to eventually reach the position for using large capacity tray 8, urging member 18 is positioned upper than projection 15*c* as shown in FIG. 3B, and hence projection 15*c* and wing 15 are not raised. Accordingly, wing 15 does not protrude upward from the belt surface of conveyor belt 14*a* as shown in FIG. 4B. Accordingly, sheet 20 is kept flat, and by the suction force generated by fan 14*b*, sheet 20 is attracted and held on conveyor belt 14*a*, and a prescribed conveying force is applied. Though upward curving by raising opposing edges of sheet 20 is not performed, such sheet has sufficient sturdiness to be discharged in flat extended state, and therefore the sheet is dropped and supplied to large capacity tray 8.

Determination as to whether wings 15 are to be used or not is made such that wings are not used when the sheet is thick and wings are used when the sheet is thin. More specifically, when the sheet is strong enough to be stacked on tray 8 in the extended straight state without upward curving, wings may not be used. Even in that case, wings may be used if the center of the sheet is sucked and attracted to be held on conveyor belts 14*a* with both edges raised by the wing, dependent on correlation between the sturdiness of the sheet and the attraction force of fan 14*b*.

Since it is possible to determine whether wings 15 are to be used or not, under a certain condition, operation lever 16 is operated so that urging force of urging member is not transmitted to wings 15 even when the large capacity tray is positioned at the discharging portion, and hence wings 15 are not raised. Even when the large capacity tray is used, upward curving may be prevented depending on condition, so that more flexible setting and operation mode in accordance with specific condition is possible, whereby sheets can be surely discharged and stacked on the tray.

Though such switching is manually performed in the present embodiment, switching may be done automatically.

Figure 5:
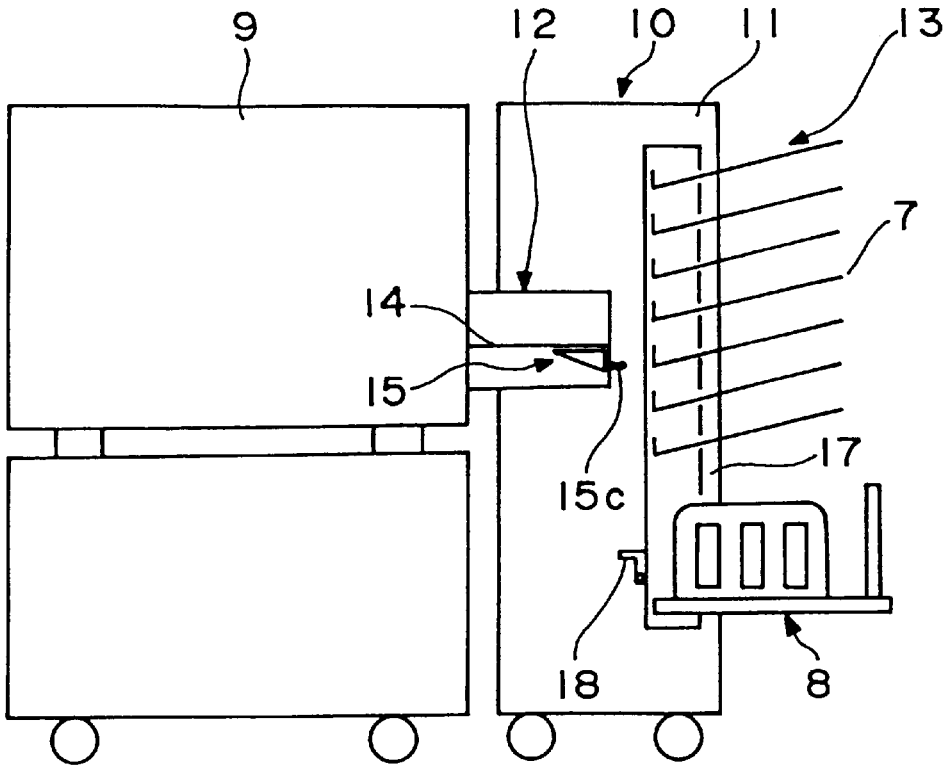
FIG. 5 shows a structure of the sheet discharging apparatus in accordance with a second embodiment of the present invention.

FIG. 5 shows a second embodiment of the sheet discharging apparatus in accordance with the present invention. Different from the embodiment descried above, in the present embodiment, urging member 18 is rotatable in forward/rearward directions about an axis 18*a* provided on frame 17, and urging member 18 assumes two positions, that is, a state where it abuts projection 15*c* of wing 15 shown in FIGS. 6A and 6B, and a state, rotated clockwise from the first state, where one side of urging member 18 is not in contact with projection 15*c* as shown in FIGS. 7A and 7B. Here, it is not necessary to move projection 15*c* in the thrust direction as in the first embodiment. Therefore, it can be formed integrally with the body of wing 15. Even when it is formed by a separate member, it is fixed at a prescribed position on the front surface of wing 15.

Figure 6A:
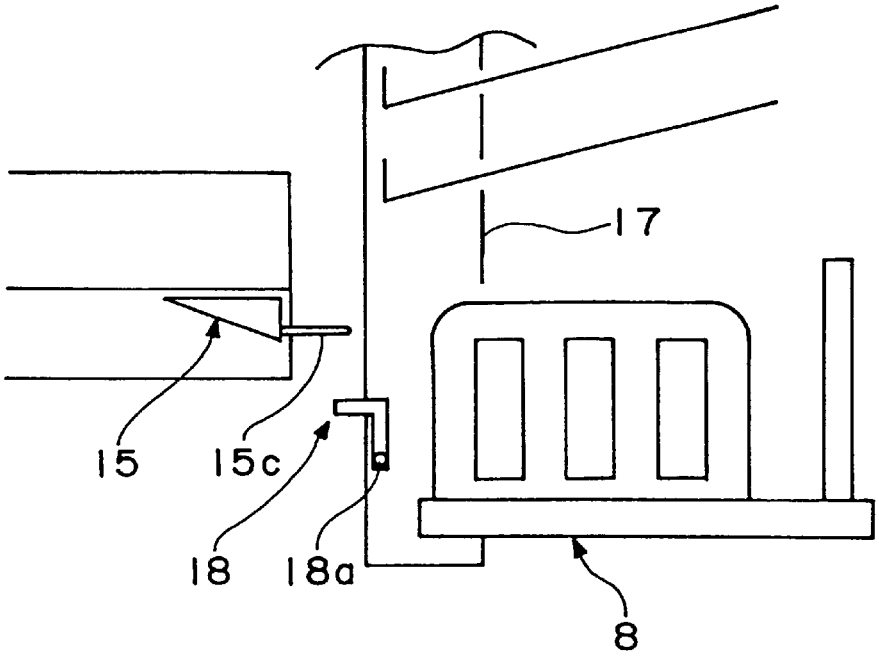
FIGS. 6A, 6B, 7A and 7B illustrate function of the second embodiment of the present invention.
Figure 6B:
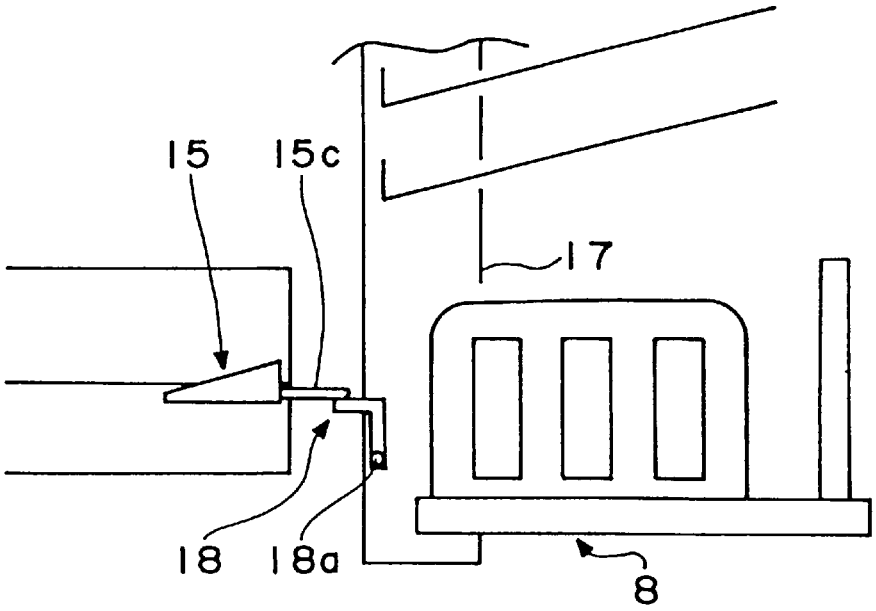
Figure 7A:
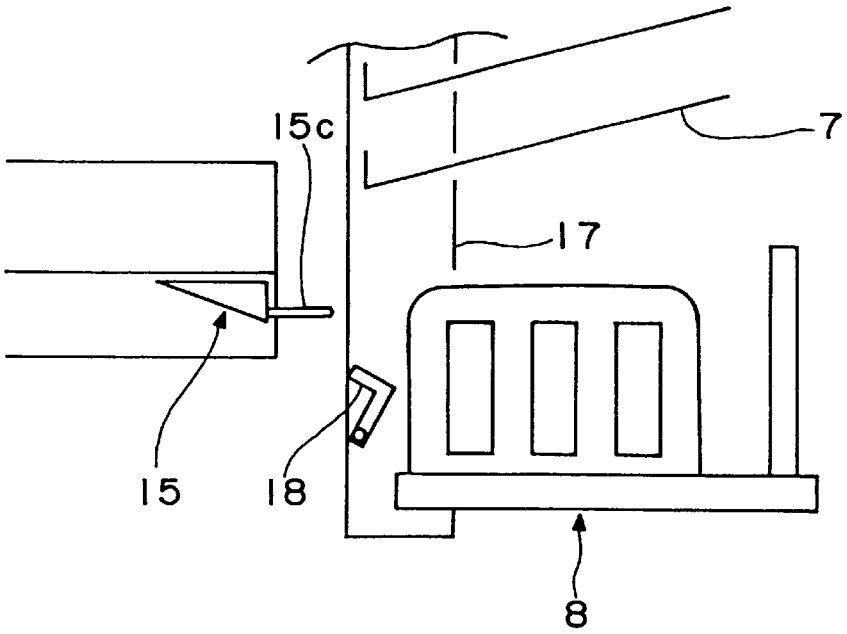
Figure 7B:
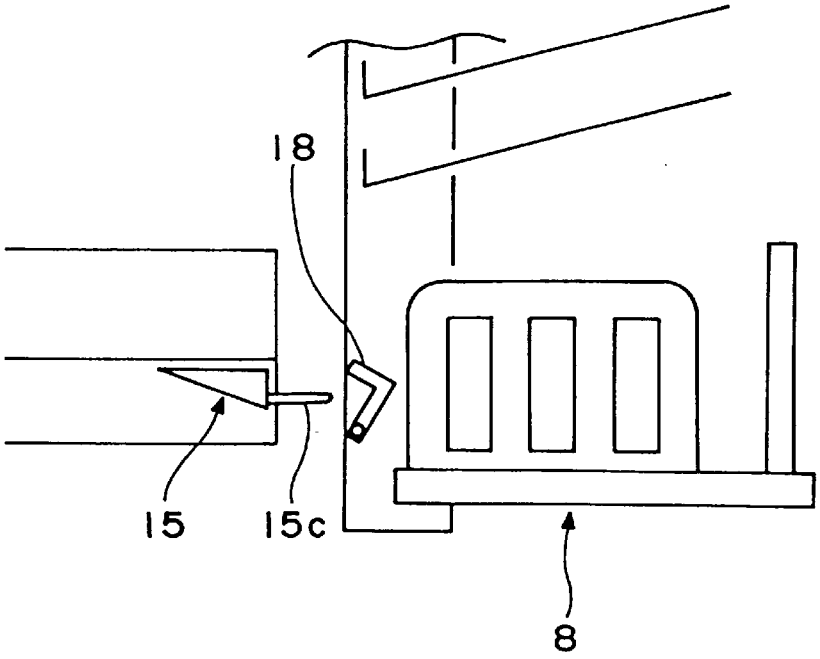
Figure 8A:
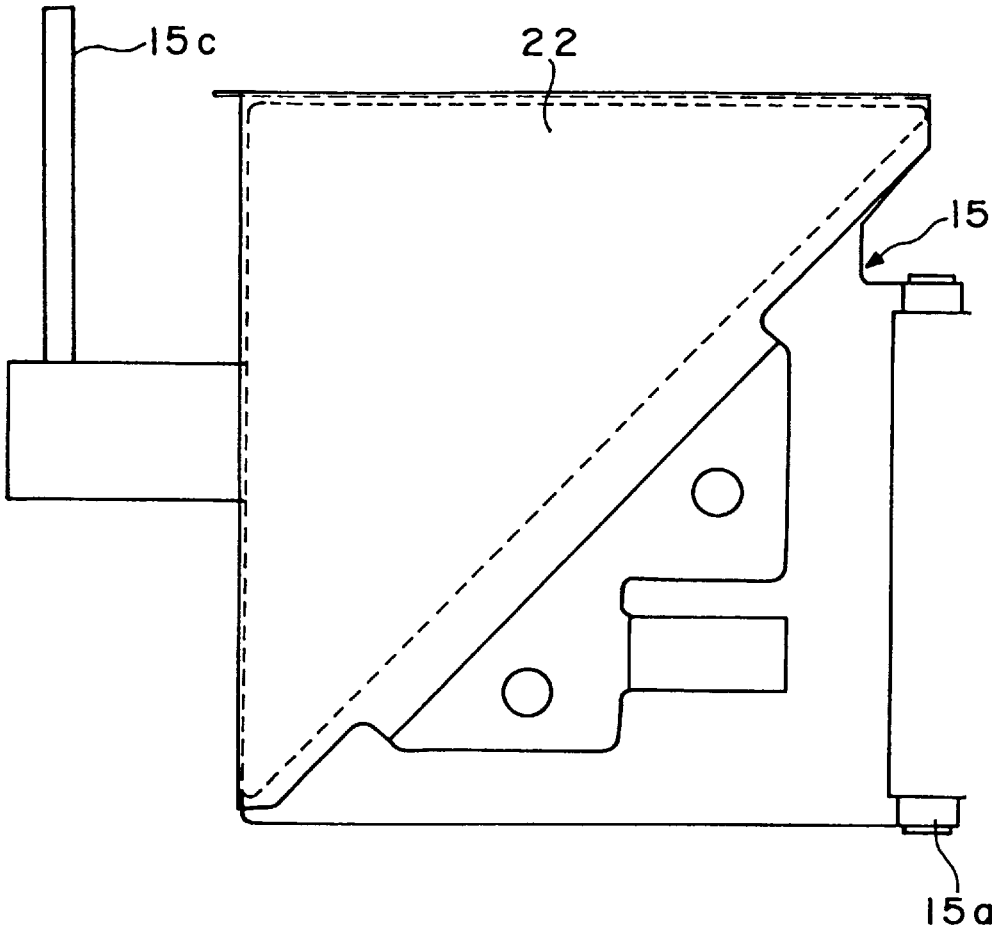
FIGS. 8A and 8B show an example of wing structure.
Figure 8B:
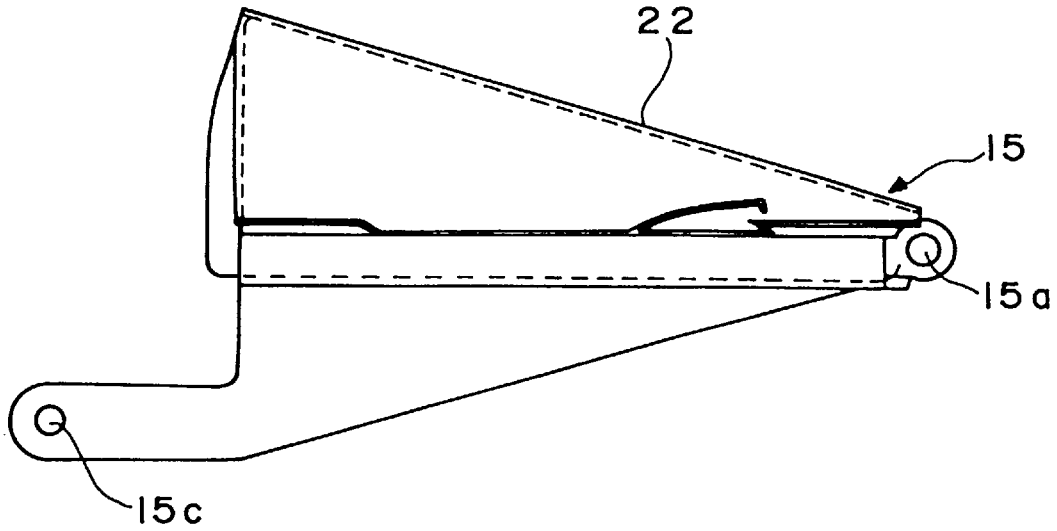
Figure 9A:
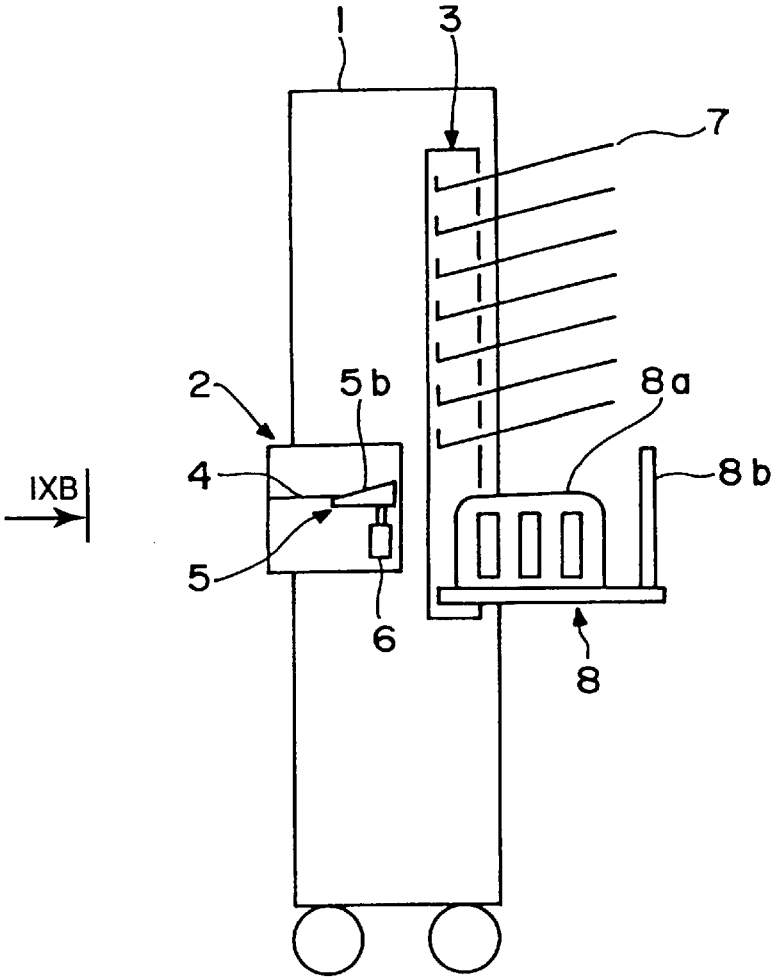
FIG. 9A PRIOR ART
FIG. 9A shows an exemplary structure of a conventional sheet stacking apparatus.
Figure 9B:
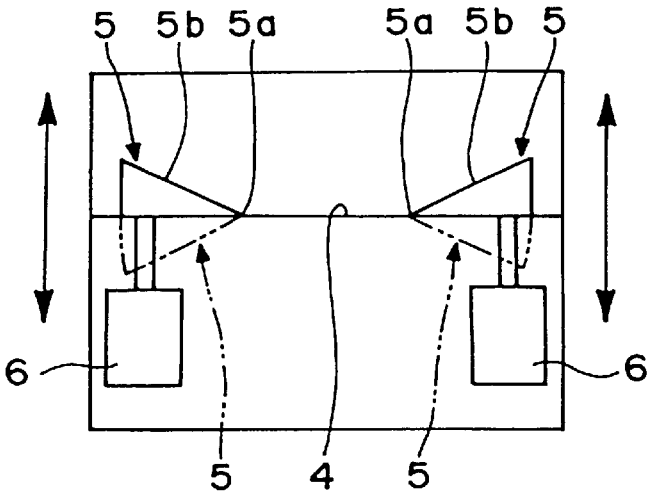
FIG. 9B PRIOR ART
FIG. 9B shows a structure for elevating/lowering wings of the conventional apparatus.
Figure 10A:
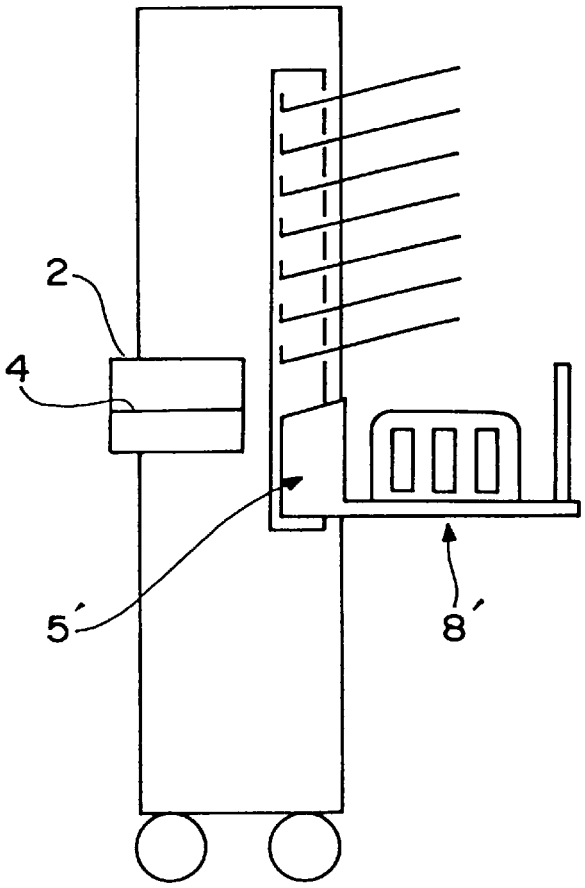
FIG. 10A PRIOR ART
FIG. 10A shows an exemplary structure of a conventional sheet discharging apparatus.
Figure 10B:
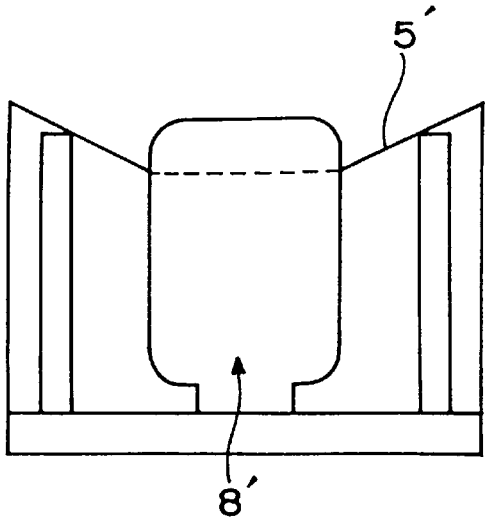
FIG. 10B PRIOR ART
FIG. 10B shows a large capacity tray of the conventional apparatus viewed from the direction of conveying the sheet.

In this structure, as in the first embodiment described above, when thin and flimsy sheets are printed and discharged to large capacity tray 8, urging member 18 is set to such an attitude as shown in FIG. 6A. Then, urging member 18 which is elevated together with large capacity tray 8 comes into contact with projection 15*c,* and presses the projection upward. When large capacity tray 8 reaches the discharging portion (the position of use) as shown in FIG. 6B, wings 15 are also elevated to the prescribed position. Accordingly, opposing edges of the sheet are raised and the sheet is discharged curved upward.

When a thick and sturdy sheet is printed and discharged, urging member 18 is set to such a position as shown in FIG. 7A. Then the urging member is not brought into contact with projection 15*c* even when large capacity tray 8 is elevated, and wings 15 are not elevated even when large capacity tray 8 is placed to the discharging position (position of use) as shown in FIG. 7B. Therefore, the sheet is discharged in the flat extended state. Other structures, functions and effects are the same as the first embodiment. Therefore, description thereof is not repeated.

The structure of the wings will be described.

Generally, wings 15 used in both embodiments described above are integrally formed to a prescribed shape by resin molding. The wing has complicated shape as it has a mechanism for elevation/lowering (rotation), and it must be positioned in a desired attitude at a prescribed position in conveyor 12 at the time of elevation and lowering, and hence it is difficult to form the wings by plate metal. Conventional wings of the type which moves upward/downward are formed of synthetic resin from the reason described above. The resin has high friction coefficient, which presents resistance in conveying when the sheet is discharged, hindering smooth feeding. Further, as the sheet moves with friction, static electricity is generated, enlarging load on the sheet which is being conveyed. This results in dropping midway or failure of feeding in the conveyor 12 as the speed of discharge decreases, possibly causing jam and failure of discharge.

Accordingly, in the embodiments of the present invention, body of wing 15 is manufactured integrally by synthetic resin as in the prior art, and at least the conveying surface (upper surface) which is in contact with the sheet is covered by a metal plate 22. This decreases friction resistance and suppresses static electricity, enabling smooth conveying and discharging process.

Though center of rotation 15*a* is provided on opposing side of wings 15, it is not limited thereto. For example, rotation axis may be provided behind in the sheet conveying direction for allowing forward/rearward rotation about an axis orthogonally intersecting the conveying direction with the front side of the wing protruded/recessed with respect to the conveyor belt.

Though the wings are returned to the second position by natural fall utilizing the weight of wings themselves in the above described embodiments, the wings may be returned to the second position by utilizing elastic force (elastic recovering force) of an elastic member such as spring or rubber.

Though the present invention is applied to an apparatus having a plurality of trays 7 for small number of sheets for sorting function, application of the present invention is not limited thereto. For example, the present invention may be applied to a sheet discharging apparatus having one tray 7 and one large capacity tray 8. In that case, the structure in which the urging member is provided near the large capacity tray and the wings are eventually elevated by the urging member as in the above described embodiments may be applied as it is. Further, the present invention may be applied as a reverse structure. More specifically, though not shown, the urging member may be provided near the tray for small number of sheets, and the wings may be set at the protruding first position when there is not an urging force. In order to maintain the first position, elastic force by an elastic member, for example, may be utilized.

The tray for stacking "small number of" sheets and the large capacity tray stacking "a large number of" sheets are only relative terms specifying the types of the trays. Here, the large capacity tray refers to that tray for which upward curving to increase stiffness by the wings is required, and the tray for the small number of sheets refers to one that does not require upward curving, regardless of the types of sheets.

The state of wings at a position "lower than the conveying surface" covers both the position which is flush with the conveying surface and the position further below, as illustrated in the embodiments. Further, this position also covers a position slightly upper than the conveying surface not higher enough to perform upward curving.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A sheet discharging apparatus having a sheet discharging unit, comprising:

a container tray movable upward/downward for receiving and stacking a discharged sheet when positioned near said discharging unit;

wings provided at said discharging unit for raising upward opposing edges of the sheet to be discharged, when the wings are urged; and an urging member moving upward/downward in relation to upward/downward movement of said container tray; wherein said wings are urged by said urging member.

2. The sheet discharging apparatus according to claim 1 further comprising switching means for switching transmission/non-transmission of urging force from said urging member to said wings, enabling selection as to whether said wings are to be elevated or not, by said switching means.

3. The sheet discharging apparatus according to claim 1, wherein at least a surface of said wings in contact with said sheet is covered by a metal cover.

4. A sheet discharging apparatus having a sheet discharging unit, comprising:

a container tray movable upward/downward for receiving and stacking a discharged sheet when positioned near said discharging unit;

wings provided at said discharging unit for raising upward opposing edges of the sheet to be discharged, when the wings are urged;

an urging member moving upward/downward in relation to the upward/downward movement of said container tray; and switching means for not transmitting urging force by said urging member to said wings when said sheet is thick, and transmitting the urging force by said urging member to said wings when said sheet is thin.

5. The sheet discharging apparatus according to claim 4, wherein said container tray includes a plurality of container trays provided in vertical direction, said urging member being attached to a lowermost one of said plurality of trays.

6. The sheet discharging apparatus according to claim 5, wherein said lowermost container tray has larger capacity than remaining ones of the plurality of trays.

* * * * *